US006749469B2

(12) United States Patent
Matsuoka

(10) Patent No.: US 6,749,469 B2
(45) Date of Patent: Jun. 15, 2004

(54) CONNECTOR WITH SIDE MOUNTED RETAINER AND SUPPORT FOR RETAINER IN CONNECTOR HOUSING

(75) Inventor: Hiroyuki Matsuoka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 85 days.

(21) Appl. No.: 10/119,490

(22) Filed: Apr. 9, 2002

(65) Prior Publication Data

US 2002/0151227 A1 Oct. 17, 2002

(30) Foreign Application Priority Data

Apr. 13, 2001 (JP) ..... 2001-115542

(51) Int. Cl.[7] ..... H01R 13/514
(52) U.S. Cl. ..... 439/752
(58) Field of Search ..... 439/157, 347, 439/752

(56) References Cited

U.S. PATENT DOCUMENTS 5,252,096 A * 10/1993 Okada ..... 439/752
5,609,503 A * 3/1997 Tsuji et al. ..... 439/752
5,755,600 A * 5/1998 Yoshida ..... 439/752
5,848,919 A * 12/1998 Nagano ..... 439/752
5,871,363 A * 2/1999 Kimura ..... 439/157
5,928,013 A * 7/1999 Iwahori ..... 439/157
6,010,374 A * 1/2000 Miwa ..... 439/752
6,045,375 A * 4/2000 Aoki et al. ..... 439/157
6,113,407 A 9/2000 Martin

* cited by examiner

*Primary Examiner*—Lynn Feild
*Assistant Examiner*—Thanh-Tam Le
(74) *Attorney, Agent, or Firm*—Anthony J. Casella; Gerald E. Hespos

(57) ABSTRACT

A connector has a housing (20) with cavities (32S) formed at a plurality of stages and configured for receiving terminals (26S). A retainer insertion opening (50) is formed in one side surface of the housing (20) for receiving a retainer (40). The retainer (40) has arms (42) for the respective stages of the cavities (32S). Locking projections (45) are formed on the arms (42) for engaging the corresponding terminals (26S). Transversely extending guide grooves (52, 52A) are formed in the front and rear surfaces of the arms (42), and ribs (57, 57A) are formed on side walls of the retainer insertion opening (50) for engaging the guide grooves (52, 52A) and preventing deformation of the arms (42).

12 Claims, 19 Drawing Sheets

CONNECTOR WITH SIDE MOUNTED RETAINER AND SUPPORT FOR RETAINER IN CONNECTOR HOUSING

BACKGROUND OF THE INVENTION

1. Field of the Invention

The invention relates to a connector with a side-type retainer.

2. Description of the Related Art

A known connector has a housing with cavities for receiving terminal fittings. A retainer insertion opening is formed in a side surface of the housing and intersects the cavities. A retainer is insertable into the retainer insertion opening and has locking projections that engage steps of the terminal fittings to lock the terminal fittings in the cavities. The housing often has terminal fittings and cavities at a plurality of stages. Thus, the retainer has a lattice-shape with horizontal arms for disposition between the stages and vertical pieces that connect the arms and extend between adjacent cavities in the respective stage.

There is an increasing demand to make connectors smaller. Attempts to meet this demand have provided a higher density of cavities. The vertical frame pieces of the retainer for such a high density array of cavities are deleted and the horizontal arms are coupled only at the opposite ends of the arms. Each arm has locking projections for engaging the cavities.

The arms of the above-described retainer are long and may deform and curve because there is no support to replace the vertical frame pieces. For example, the retainer may be mounted beforehand at a partial locking position where insertion and withdrawal of terminal fittings into and from cavities should be permitted. The retainer then may be pushed to a full locking position after the terminal fittings are inserted. However, deformed arms of the retainer may permit the retainer to move to the full locking position even though a terminal fitting may not be inserted completely. Additionally, deformed portions of the arms may project into the cavities and prevent insertion of the terminal fittings when the retainer is in the partial locking position.

The present invention was developed in view of the above problem and an object thereof is to prevent a deformation of a retainer.

SUMMARY OF THE INVENTION

The invention is directed to a connector that has a housing with one or more cavities into which one or more terminal fittings are insertable. A retainer insertion opening is formed in one side surface of the housing and extends at an angle to an inserting direction of the terminal fittings. A retainer is insertable into the retainer insertion opening and has one or more locks for locking the corresponding terminal fittings. At least one groove and at least one rib are provided between the retainer and at least one side wall of the retainer insertion opening. The groove and the rib extend in an inserting direction of the retainer and are engageable with each other.

The rib is slid along the groove as the retainer is inserted into the retainer insertion opening. The engagement of the rib and groove prevent the retainer from being deformed and ensure smooth insertion of the retainer.

The cavities preferably are formed at a plurality of stages in the connector housing, and the retainer has arms for the respective stages of the cavities. The locks are formed on the arms, and the groove and the rib preferably are formed between a side surface of each arm and the side wall of the retainer insertion opening that faces the side surface of the arm.

The retainer preferably can be held at a partial locking position where the locks are retracted laterally from the corresponding cavities to permit the insertion and withdrawal of the terminal fittings. The retainer also can be held at a full locking position where the locks are inside the corresponding cavities to lock the terminal fittings in the cavities. The retainer preferably is held at the partial locking position and/or at the full locking position by locking means on the retainer and the housing. The ability to hold the retainer on the housing at the partial locking position facilitates handling of the connector.

The rib preferably is formed with slanted portions to be guided into the corresponding groove.

The rib and/or the groove preferably have a length that corresponds substantially to the length of the retainer.

A slider preferably is mounted on the housing and has a cam mechanism to facilitate connection of the housing with a mating housing.

A detector preferably is provided on the retainer for interacting with the slider and detecting an insufficient insertion of the retainer.

The housing preferably has at least one rounded portion for contacting the detector of the retainer and for moving the retainer from a slightly displaced position to the full locking position.

These and other objects, features and advantages of the present invention will become more apparent upon reading of the following detailed description of preferred embodiments and accompanying drawings. It should be understood that even though embodiments are described separately, single features may be combined to additional embodiments.

DETAILED DESCRIPTION OF THE PREFERRED EMBODIMENTS

A connector in accordance with a preferred embodiment of the invention is of the type whose connection and disconnection are assisted by a leverage function of a slider. The connector has a male housing 10 made e.g. of a synthetic resin. The male housing 10 has a main body 11 in the form of a laterally long block and a small receptacle 12 that projects from the front surface of the main body 11.

Figure 2:
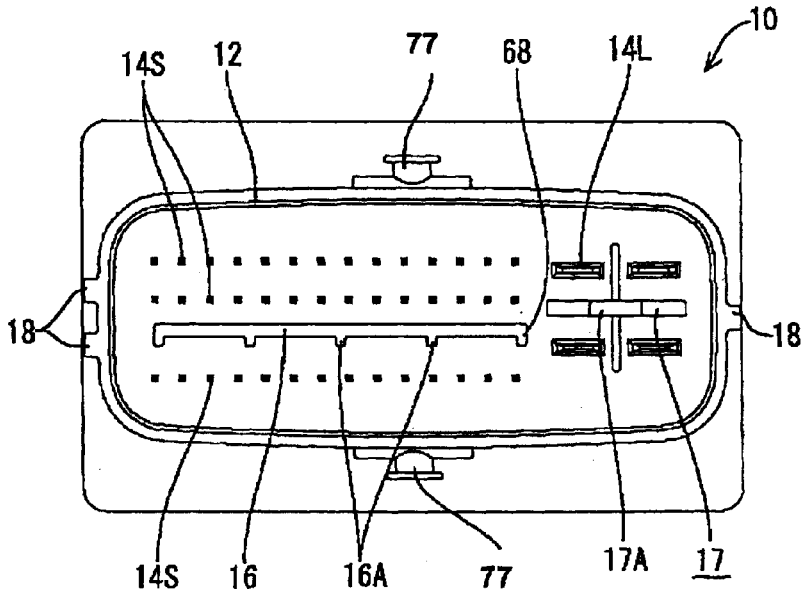
FIG. 2 is a front view of the male housing.

Large male terminals 14L and small male terminals 14S are mounted in the male housing 10. More specifically, as shown in FIG. 2, four large male terminals 14L project from a right area of the back surface of the small receptacle 12 when viewed from the front and define a 2×2 array. A row of 14 small male terminals 14S projects at each of three stages in a remaining area. Of course, other embodiments may have different numbers and arrangements of terminal fittings. The space between the middle and bottom stages of the small male terminals 14S is wider than the space between the middle and top stages thereof.

Figure 3:
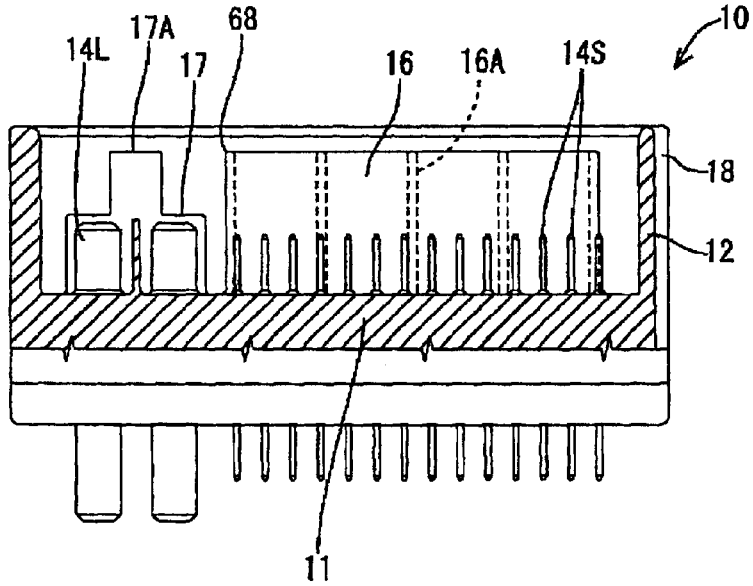
FIG. 3 is a plan view partly in section of the male housing.
Figure 4:
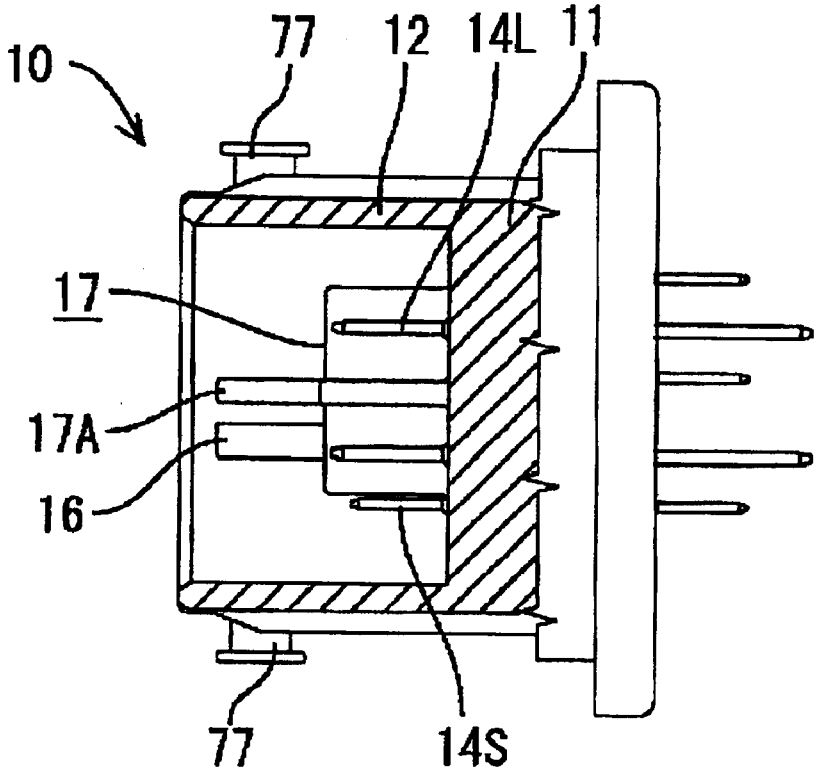
FIG. 4 is a side view partly in section of the male housing.
Figure 5:
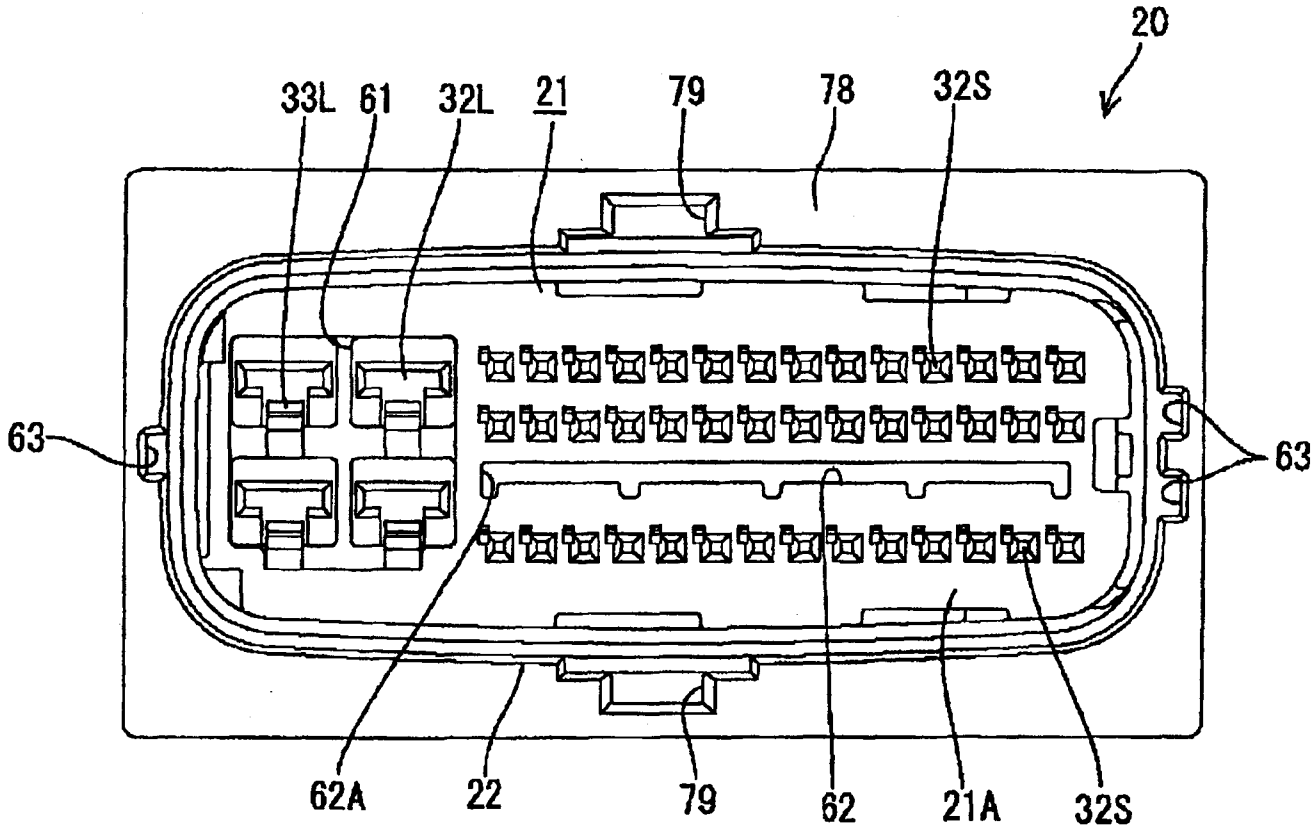
FIG. 5 is a front view of the female housing.
Figure 6:
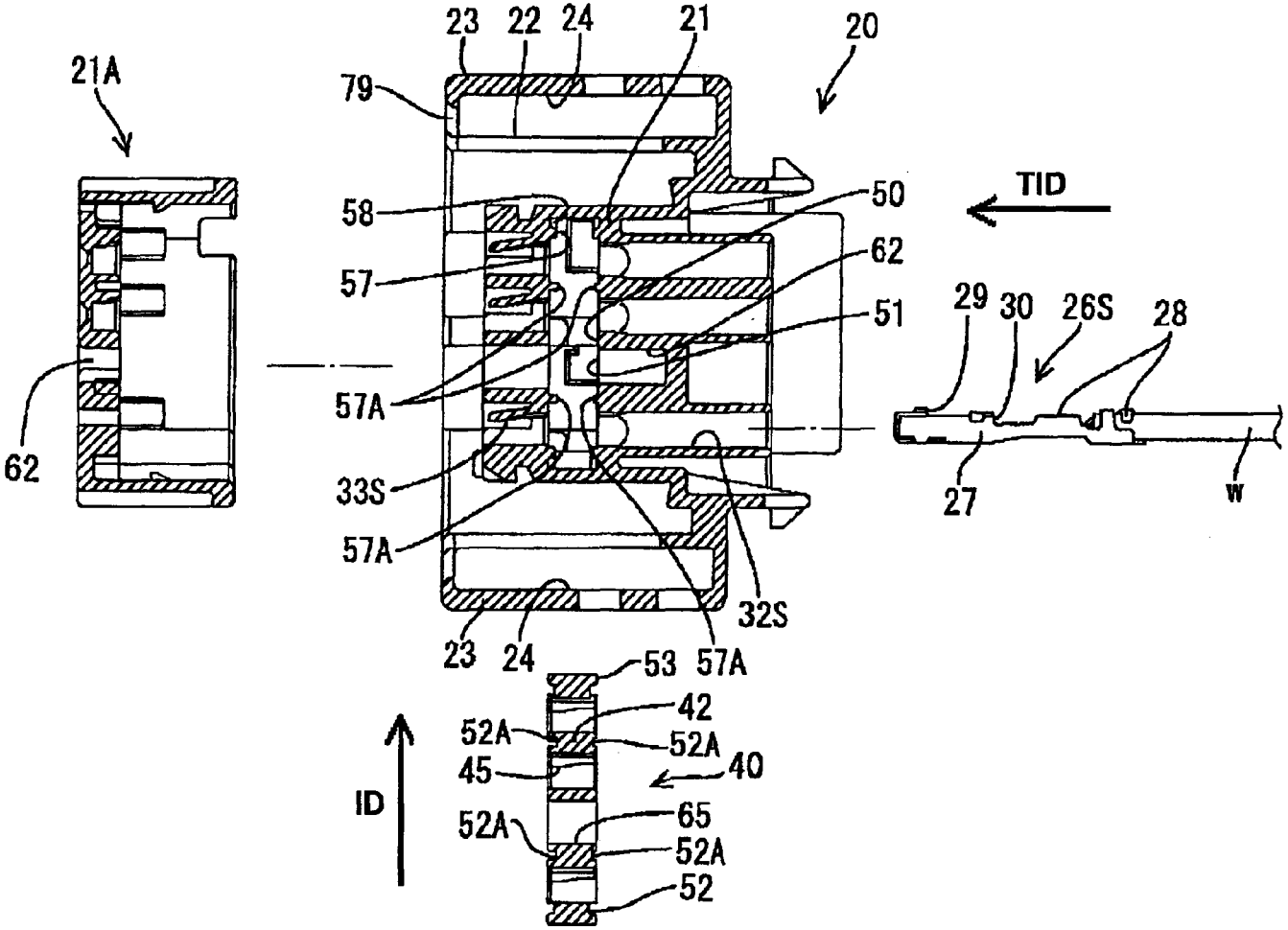
FIG. 6 is an exploded longitudinal section of the female housing.

The male housing 10 has a lateral rib 16 between the middle and bottom stages of the small male terminals 14S. The lateral rib 16 is substantially parallel with the stages of the small male terminals 14S and has substantially the same length as the stages of the small male terminals 14S. Five spaced-apart reinforcing ribs 16A are formed on the lower surface of the lateral rib 16, as shown in FIGS. 2 and 3. A cross rib 17 defines a partition between the large male terminals 14L. The cross rib 17 is cross-shaped at its base, and a laterally extending projection 17A projects forward substantially from the center of the cross rib 17. Three outer ribs 18 are formed on the outer surface of the small receptacle 12. Two outer ribs 18 are on the left side and one outer rib 18 is on the right side when viewed from front The connector also includes a female housing 20 made e.g. of a synthetic resin and formed as shown in FIGS. 5 and 6. Specifically, the female housing 20 has a flat tower 21 that is fittable into the small receptacle 12 of the male housing 10. A front-stop 21A is formed separately from the tower 21, as shown in FIG. 6, and is assembled later with the tower 21. The female housing 20 also has a large receptacle 22 located around the tower 21 and fittable around the small receptacle 12. Covers 23 are formed at a specified distance from the upper and lower surfaces of the large receptacle 22, and insertion paths 24 are formed between the covers 23 and the upper and lower surfaces of the large receptacle 22. The insertion paths 24 have substantially closed front and rear ends and substantially open left and right ends.

Large female terminals 26L and small female terminals 26S are accommodated in the tower 21. Each large female terminal 26L (see chain line in FIG. 9) has a known construction with opposite front and rear ends. A connecting portion is formed at the front end, and is configured for connection with the large male terminal 14L. The rear end of each large female terminal 26L is connected with an end of a thick wire. Each small female terminal 26S also has opposite front and rear ends. A rectangular tubular connecting portion 27 is formed at the front end and is configured for connection with the mating small male terminal 14S. The rear end of the small female terminal 26S is connected with an end of a thinner wire w by crimping barrels 28, as shown in FIG. 6. An engaging portion 29 is formed near the leading end of the upper surface of the connecting portion 27, and the rear of the upper surface of the connecting portion 27 defines a jaw 30.

The tower 21 has four large cavities 32 L for accommodating the large female terminals 26L. The large cavities 32 define a 2×2 array in the left end area when viewed from the front and substantially correspond to the large male terminals 14L, as shown in FIG. 5. Fourteen small cavities 32S are disposed in the remaining area for accommodating the small female terminals 26S. The small cavities 32S are formed at each of three stages to substantially correspond to the small male terminals 14S.

A large resiliently deformable lock 33L is formed at the bottom of each large cavity 32L for partially locking the corresponding large female terminal 26L. On the other hand, a small resiliently deformable lock 33S is formed at the ceiling of each small cavity 32S for engaging and partially locking the engaging portion 29 of the corresponding small female terminal 26S.

Figure 7:
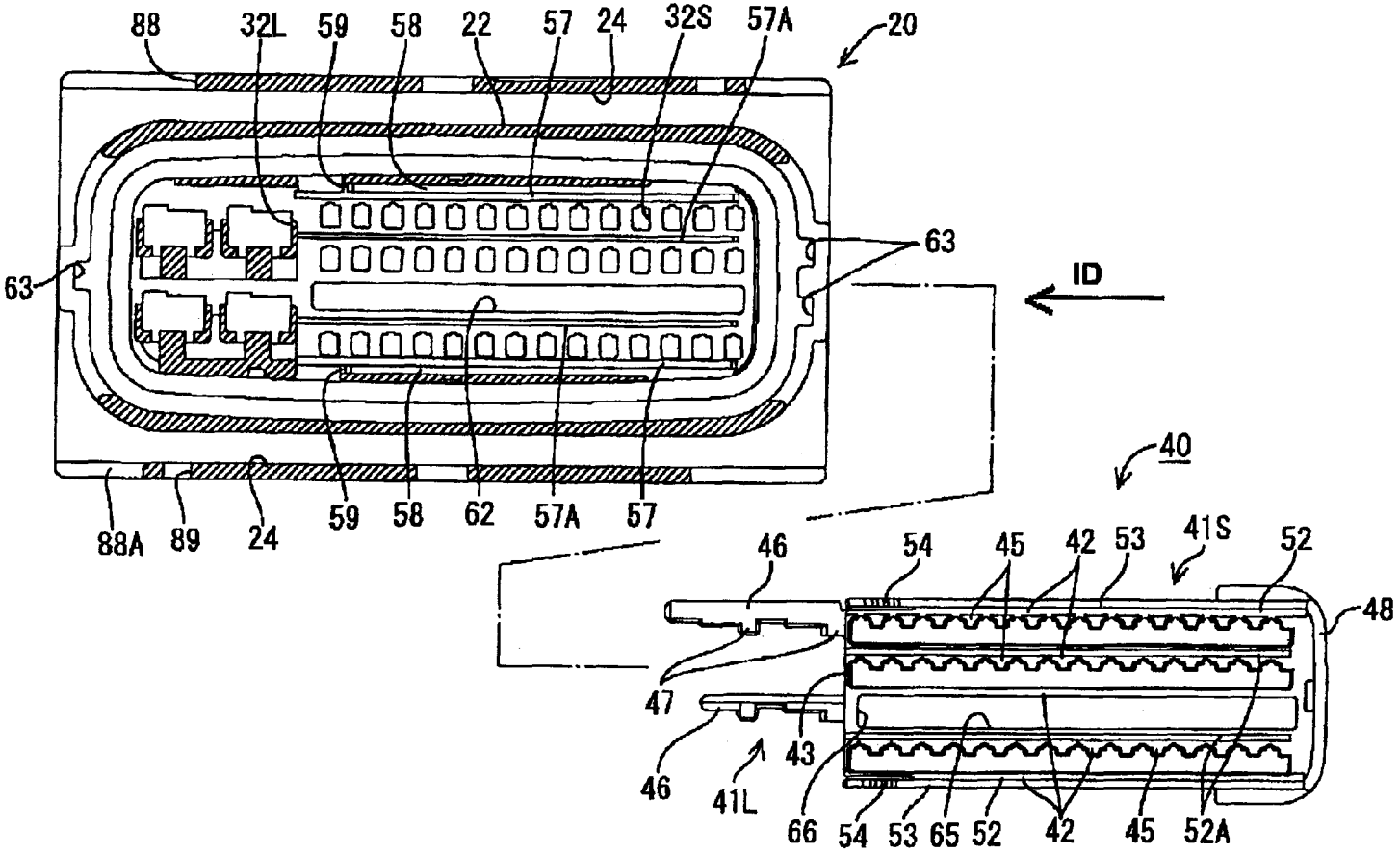
FIG. 7 is an exploded lateral section of the female housing and a retainer showing a structure of a portion of the retainer to be inserted.
Figure 8:
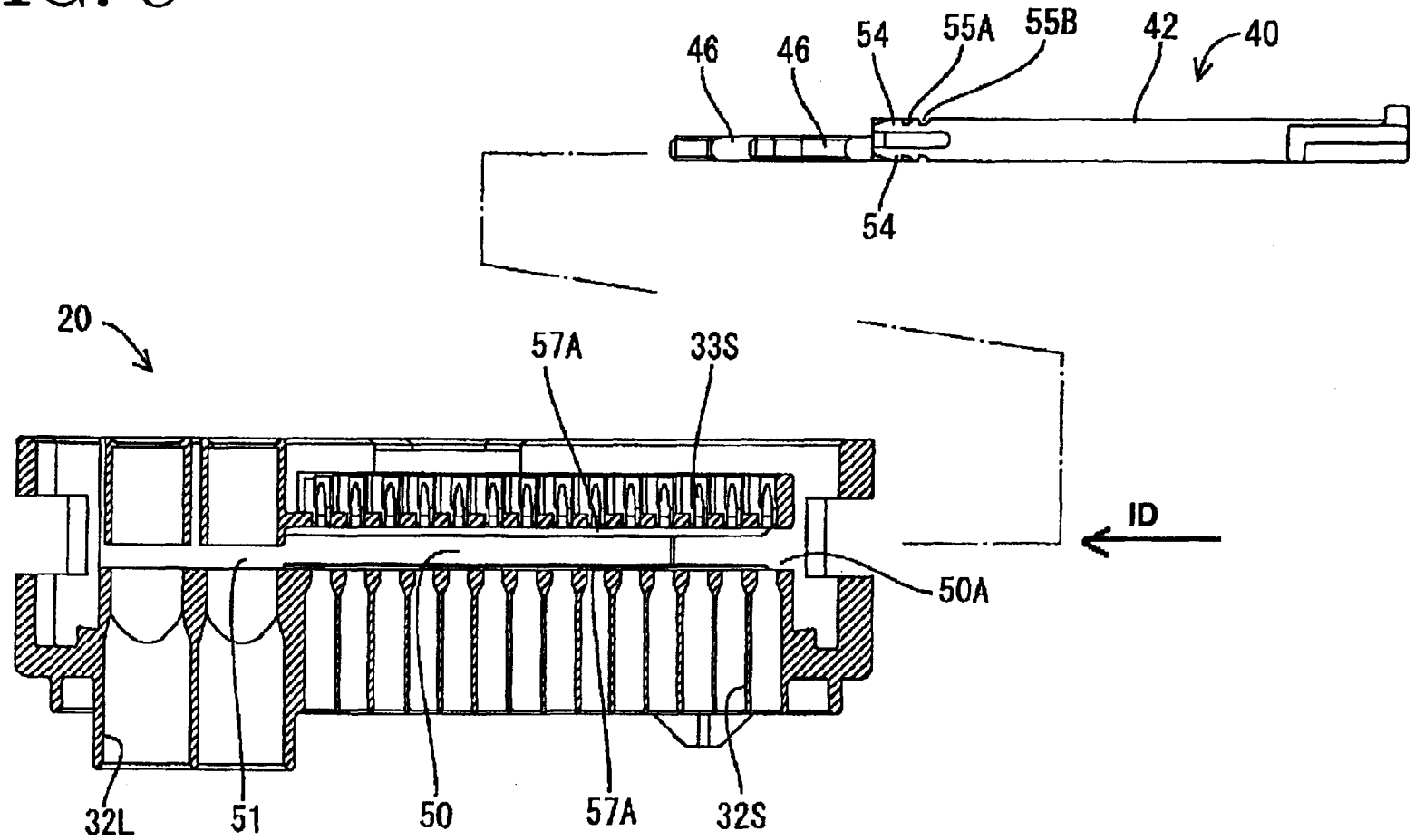
FIG. 8 is an exploded bottom view partly in lateral section of the female housing and the retainer.

A retainer 40 for doubly locking the large and small female terminals 26L, 26S is mountable on the female housing 20 in an insertion direction ID that is substantially normal to a terminal insertion direction TID of the small and large terminal fittings 26S, 26L. This retainer 40 is made e.g. of a synthetic resin and is formed as shown in FIGS. 7 and 8. The retainer 40 is comprised of a small female terminal lock portion 41S and a large female terminal lock portion 41 L.

The small female terminal lock portion 41S is formed, as shown in FIG. 7, with five spaced-apart laterally extending arms 42 arranged substantially one over another. Opposite ends of the arms 42 are connected by vertical frame pieces 43. Locks 45 are formed on the lower surface of each of the first, second and fourth arms 42 at substantially the same intervals as the small cavities 32S, and are engageable with the jaws 30 of the small female terminals 26S. Thus, the first, second and fourth arms 42 function to doubly lock the terminals.

The large female terminal lock portion 41 L has two cantilevers 46 that extend from the left vertical frame piece 43 of the small female terminal lock portion 41S and correspond to the upper and lower rows of the large cavities 32L. Locks 47 are formed on the lower surface of each cantilever 46 at substantially the same intervals as the large cavities 32L and are engageable with the large female terminals 26L.

An operable portion 48 is formed at the right end of the retainer 40 in FIG. 7, and is used to insert and withdraw the retainer 40.

A retainer insertion opening 50 extends into the tower 21 at a position slightly behind the locks 33L, 33S, as shown in FIGS. 6 and 8, and intersects the terminal insertion direction TID. The right side of the retainer insertion hole 50 when viewed from the front serves as an entrance 50A for inserting the retainer 40 along an insertion direction ID. The small female terminal lock portion 41S is closely insertable into a space of the retainer insertion opening 50 where the small cavities 32S are formed. An insertion groove 51 is formed in the back surface of the retainer insertion opening 50 with respect to the inserting direction ID of the retainer 40 and accommodates the two cantilevers 46 of the large female terminal lock 41L.

Transversely extending guide grooves 52 are formed in both front and rear surfaces of each of the uppermost and bottommost arms 42 of the small female terminal locks 41S of the retainer 40 over substantially the entire length. The upper side of the guide grooves 52 of the uppermost arm 42 and the lower side of the guide grooves 52 of the bottommost arms 42 bulge out to form bulging-out edges 53. Front and rear locking pieces 54 are formed at the front end of each bulging-out edge 53 with respect to the inserting direction ID of the retainer 40 and are resiliently deformable toward and away from each other. As shown in FIG. 8, partial and full locking recesses 55A and 55B are formed one after the other in the outer edge of each locking piece 54.

Transversely extending ribs 57 are formed on the front and rear walls of the retainer insertion opening 50, as shown in FIG. 6, and are fittable into the guide grooves 52 of the retainer 40. Insertion grooves 58 are formed above the uppermost rib 57 and below the bottommost rib 57 for receiving the upper and lower surfaces of the retainer 40 from the locking pieces 54 to the bulging-out edges 53. Projections 59 are formed at the back side of each insertion groove 58 and are engageable with the partial locking recesses 55A and the full locking recesses 55B.

Figure 9:
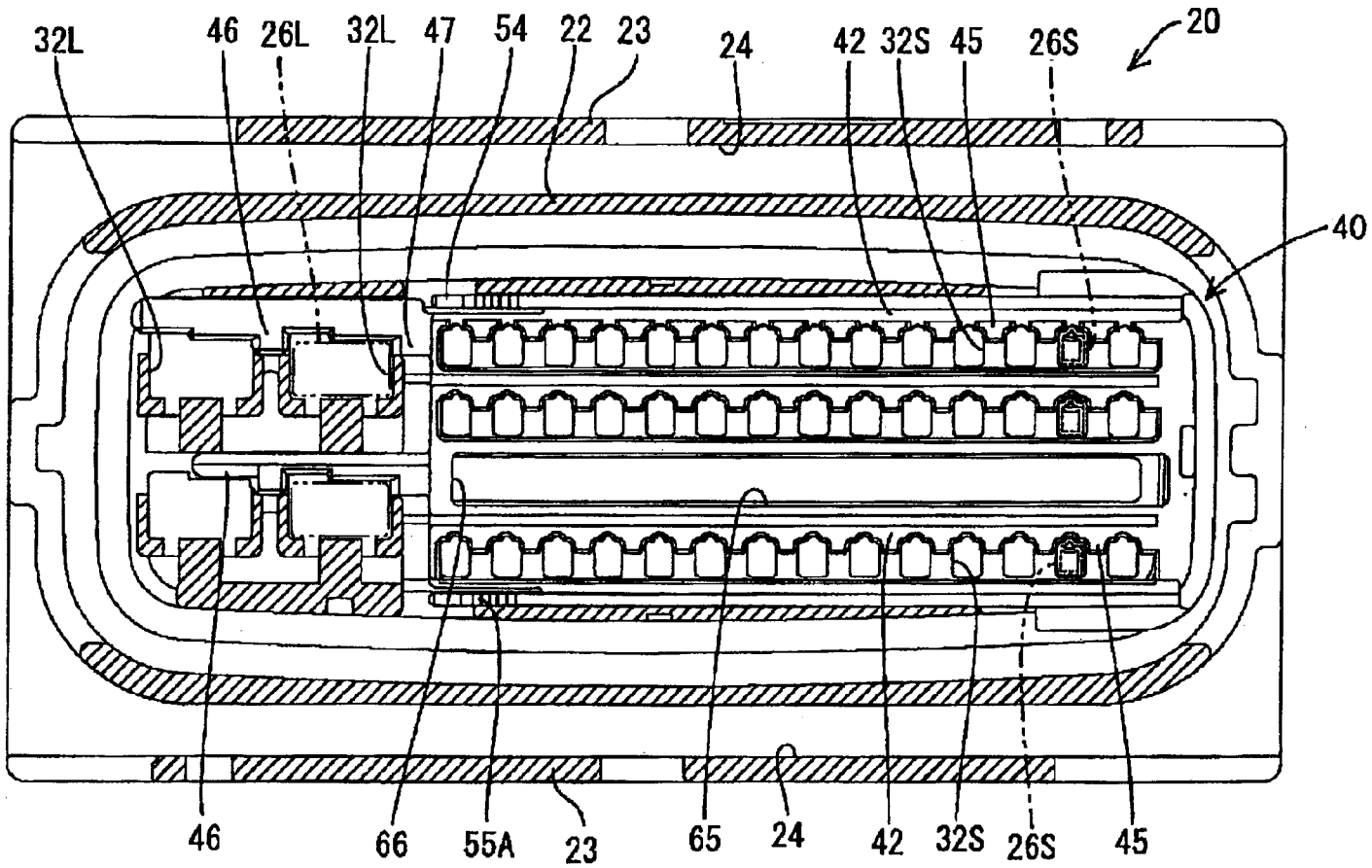
FIG. 9 is a lateral section showing a state where the retainer is at a partial locking position.
Figure 10:
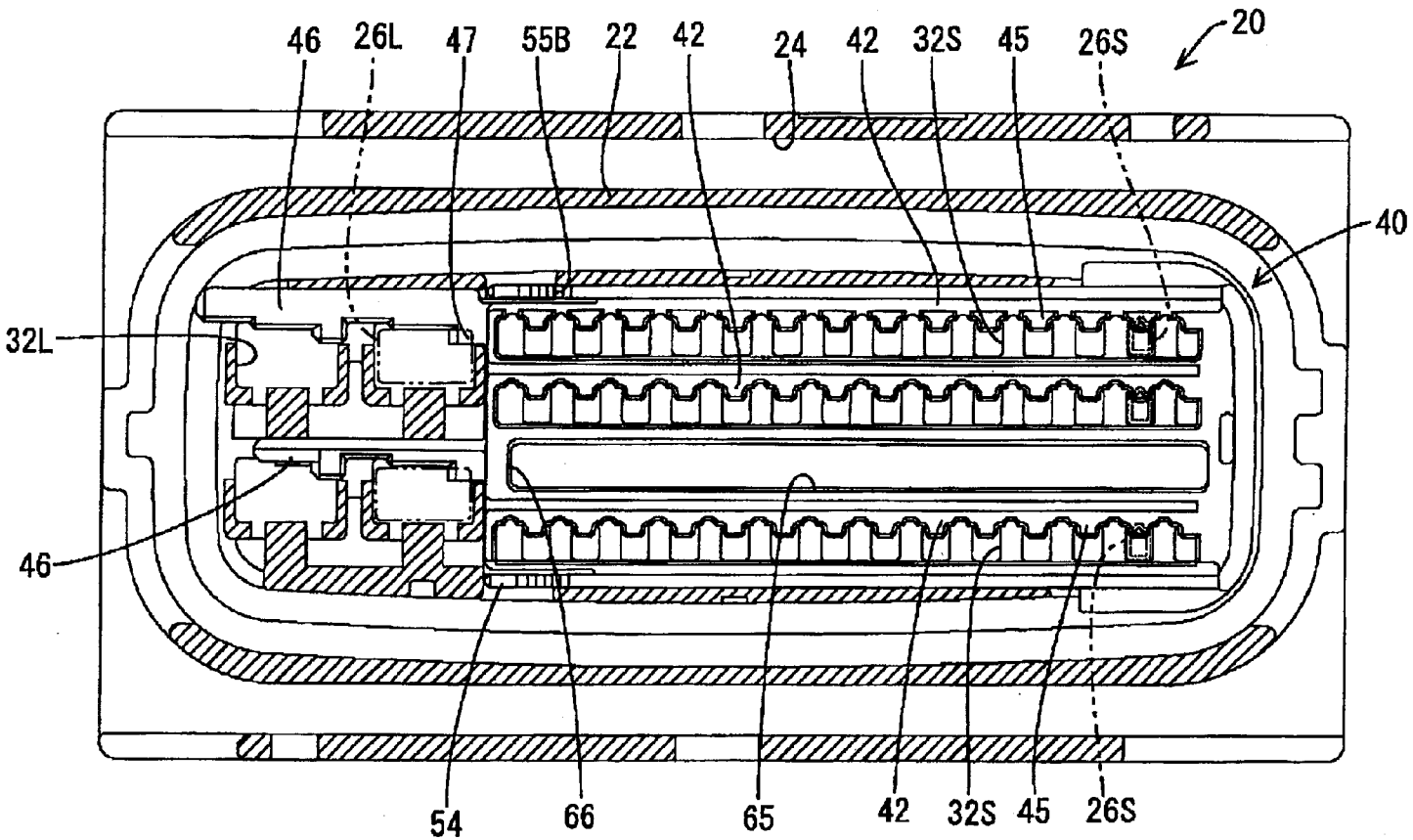
FIG. 10 is a lateral section showing a state where the retainer is at a full locking position.

Accordingly, the retainer 40 can be held at a partial locking position, as shown in FIG. 9, by being inserted into the retainer insertion opening 50 and having the partial locking recesses 55A of the locking pieces 54 engage the projections 59. At this partial locking position, the respective locking projections 45, 47 are located before or at the outside of the corresponding cavities 32S, 32L to permit the insertion and withdrawal of the corresponding female terminals 26S, 26L into the cavities 32S, 32L. On the other hand, the retainer 40 is held at a full locking position as shown in FIG. 10 by engaging the full locking recesses 55B of the locking pieces 54 with the projections 59. At this full locking position, the respective locking projections 45, 47 project into the cavities 32S, 32L to doubly lock the inserted female terminals 26S, 26L.

The arms 42 of the small female terminal locking portion 41S that have the locks 45 also have transversely extending guide grooves 52A at the upper sides of both front and rear surfaces as shown in FIGS. 6 and 7. Each guide groove 52A has an open front end and a closed rear end.

Transverse ribs 57A are formed on the front and rear surfaces of the retainer insertion opening 50 and fit into the guide grooves 52A. The ribs 57A extend from a position slightly inside the entrance 50A of the retainer insertion opening 50 to a back-end position of the rows of the small cavities 32S. Slanted guide surfaces are formed on the front ends of the ribs 57.

The female housing 20 is formed with a cross groove 61 in the front surface of the tower 21 between the large cavities 61, as shown in FIG. 5, The cross groove 61 is configured to receive the cross rib 17 of the male housing 10. On the other hand, a lateral groove 62 is formed in the front surface of the tower 21 between the middle and bottom stages of the small cavities 32S. The lateral groove 62 has a laterally long rectangular cross section slightly larger than the lateral rib 16 without conforming to the shape of the reinforcing ribs 16A in its portions before and after the retainer insertion opening 50.

Grooves 63 are formed in the inner surfaces of the large receptacle 22 for receiving the outer ribs 18 of the male housing 10.

A through hole 65 is formed in the retainer 40 between the third and fourth arms 42, as shown in FIG. 7 to receive the lateral rib 16 of the male housing 10. The through hole 65 is slightly larger in the height direction than the lateral rib 16. A detector 66 is defined at the front edge of the through hole 65 with respect to the inserting direction ID of the retainer 40 and is aligned with a back edge 62A (left edge in FIG. 5) of the lateral groove 62 in the front-stop portion 21A when the retainer 40 is moved to the full locking position.

A rounded portion 68 is formed at a corner of the leading end of the lateral rib 16, as shown in FIG. 3, and will mate with the back edge 62A in the lateral groove 62 shown in FIG. 5.

Figure 11:
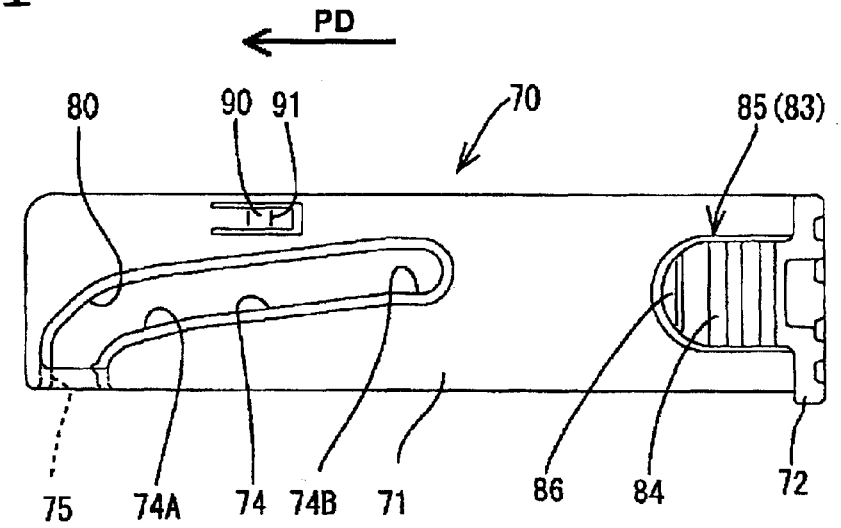
FIG. 11 is a bottom view of a slider.
Figure 12:
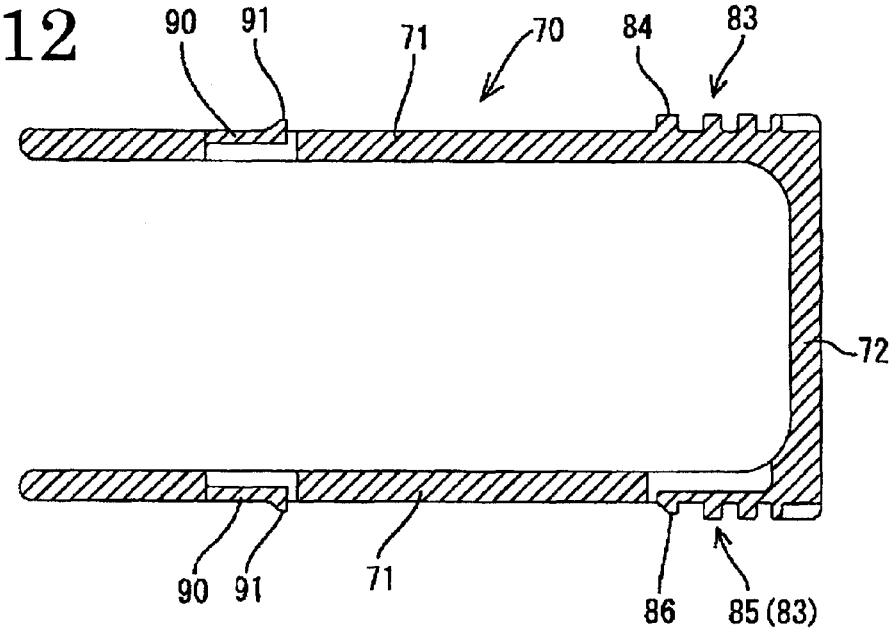
FIG. 12 is a longitudinal section of the slider.
Figure 13:
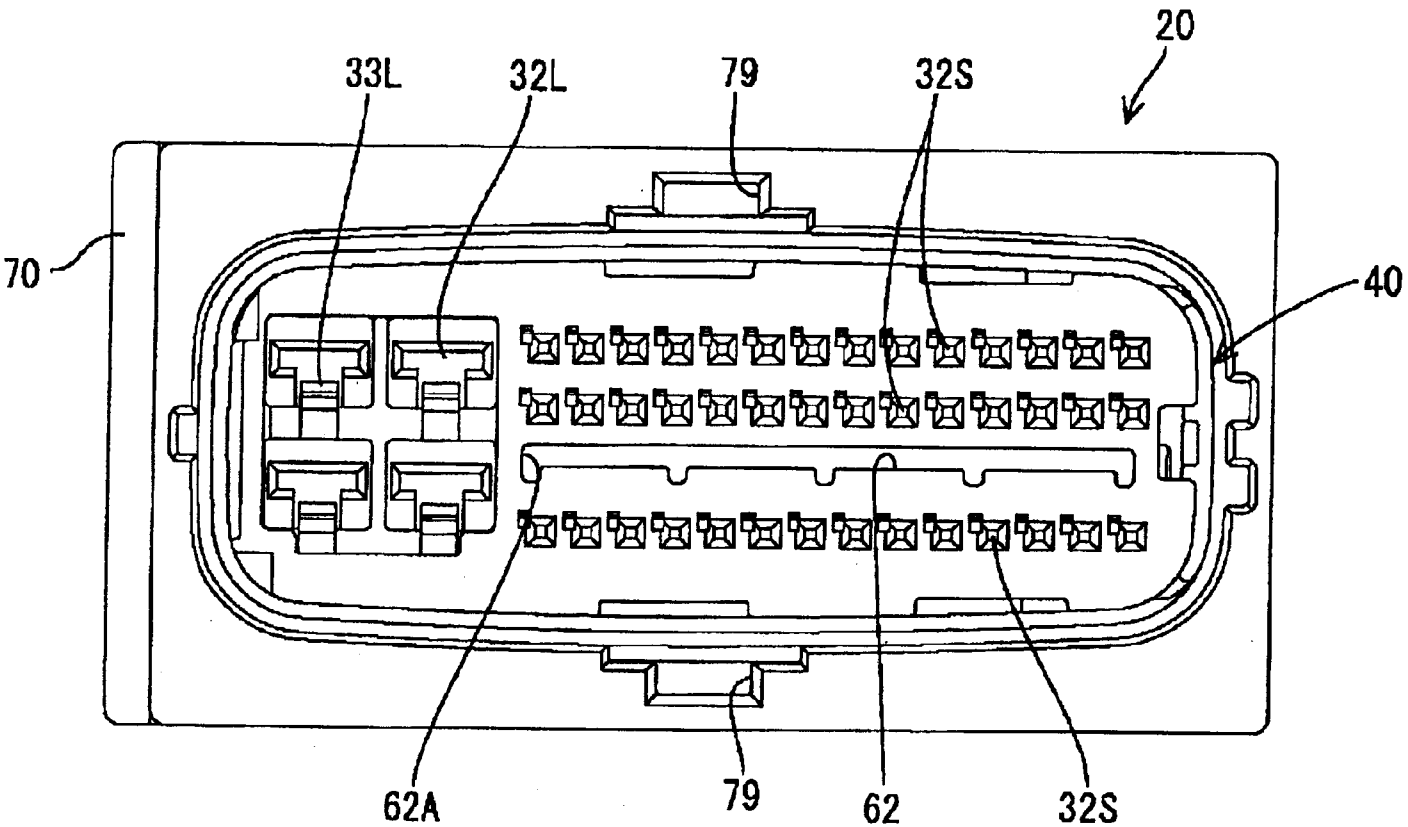
FIG. 13 is a front view of the female housing with the slider mounted at an advanced position.

A U-shaped slider 70 is mounted on the female housing 20. The slider 70 is made e.g. of a synthetic resin and has two slideable plates 71 with base ends connected by a coupling plate 72, as shown in FIGS. 11 and 12. The slider 70 is mounted from either the left or the right side wall of the female housing 10 by inserting the slidable plates 71 into the insertion paths 24.

Each slidable plate 71 has a cam groove 74 that extends from the front end of the slidable plate 71 to a longitudinal middle position. The cam groove 74 also has an entrance 75 that is open at a right angle to the front edge of the slidable plate 71 and communicates with a starting end 74A of the cam groove 74. Thus, the cam groove 74 extends at an acute angle to the pushing direction PD of the slider 70.

Figure 1:
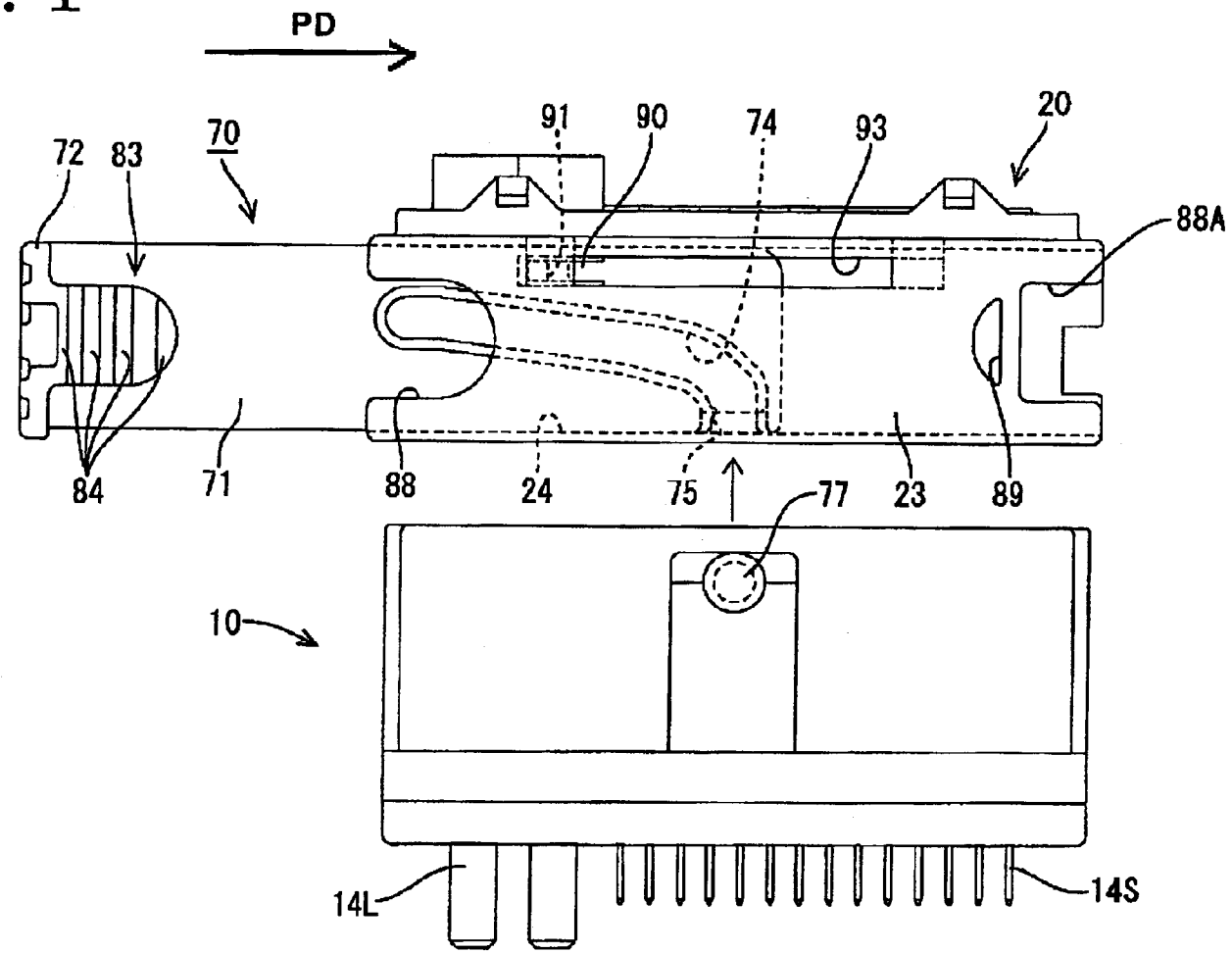
FIG. 1 is a plan view of a connector according to one embodiment of the invention before male and female housings are connected.

Follower pins 77 extend from widthwise center positions of the upper and lower surfaces of the small receptacle 12 near the front edges, as shown in FIGS. 1 and 2, and are engageable with the cam grooves 74. Through holes 79 are formed at widthwise center positions of front plates 78 of the upper and lower insertion paths 24 of the female housing 20, as shown in FIG. 5, and permit the entrance of the follower pins 77.

Figure 19:
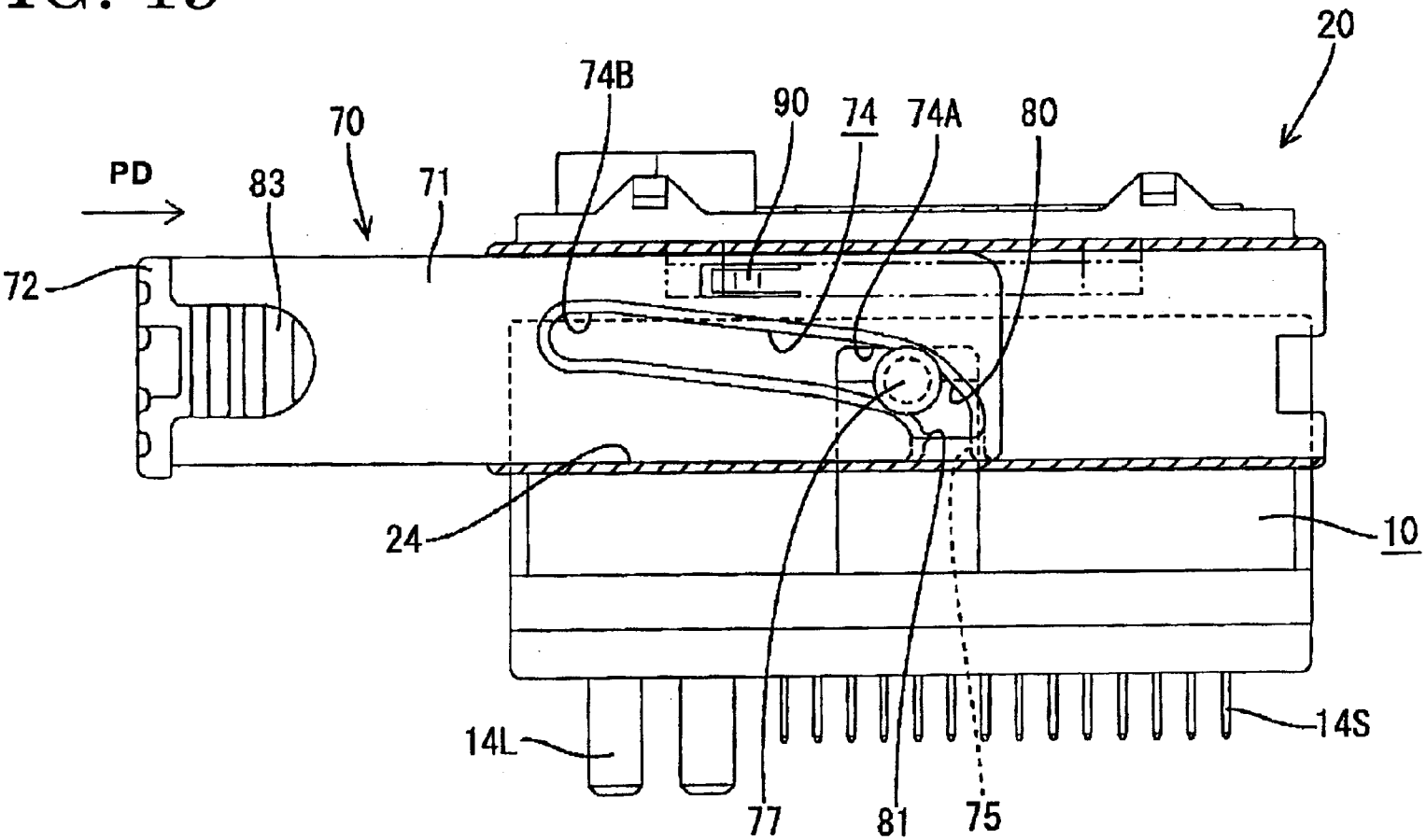
FIG. 19 is a plan view partly in section showing an initial state of connection of the male and female housings.

A steeply inclined draw-in portion 80 is formed at a portion of each cam groove 74 slightly inside the entrance 75. Thus, the follower pin 77 enters through the entrance 75 of the cam groove 74 as shown in FIG. 19, the slider 70 is moved to the right side of FIG. 19 by a specified distance by successively pressing the inclined part of the draw-in portion 80.

A stopper projection 81 (FIG. 19) is formed slightly inside the entrance 75 on one wall surface of each cam groove 74 for locking the follower pin 77 so as not to come out.

Grips 83 are formed on outer surfaces of the base ends of the slidable plates 71 to manipulate the slider 70. Each grip 83 is half of an oblong circle, as shown in FIG. 1, and has anti-slip elongated projections 84.

One grip 83 has its rear surface thinned, as shown in FIGS. 11 and 12, and a slit is made around it. Thus, this grip 83 also serves as a resiliently deformable locking piece 85. The locking piece 85 also has the elongated projection 84 at the leading end that serves as a locking claw 86. The front surface of the locking claw 86 is slanted, as shown in FIG. 12.

Escaping slots 88 are formed at the opposite left and right ends of the upper and lower covers 23 of the female housing 20 to permit the escape of the gripping portion 83 of the slider 70. Escaping slots 88A are formed at the opposite left and right ends of the upper and lower covering portions 23 of the female housing 20 for escaping the locking piece 85.

Figure 14:
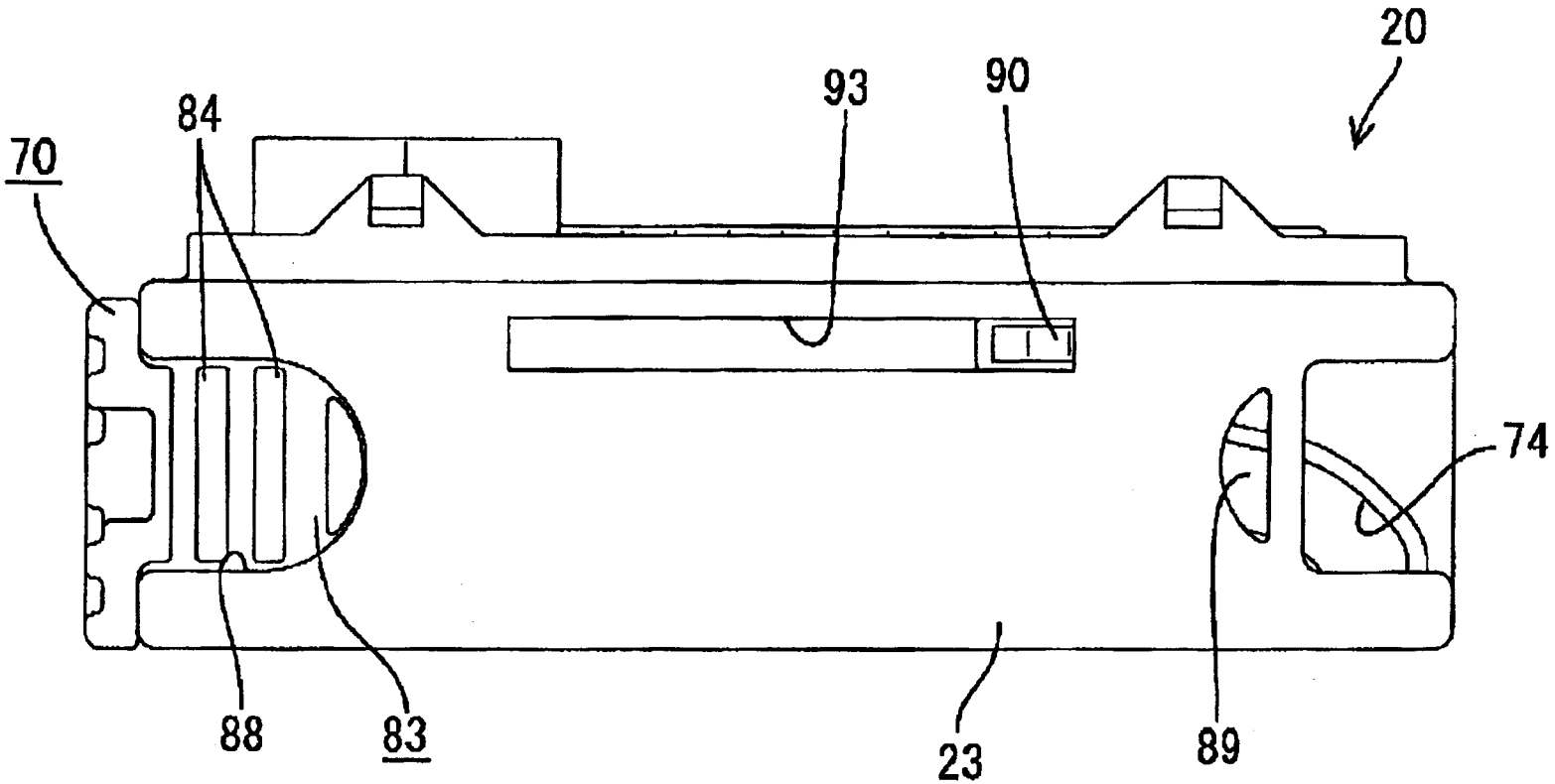
FIG. 14 is a plan view of the female housing with the slider mounted at the advanced position.
Figure 15:
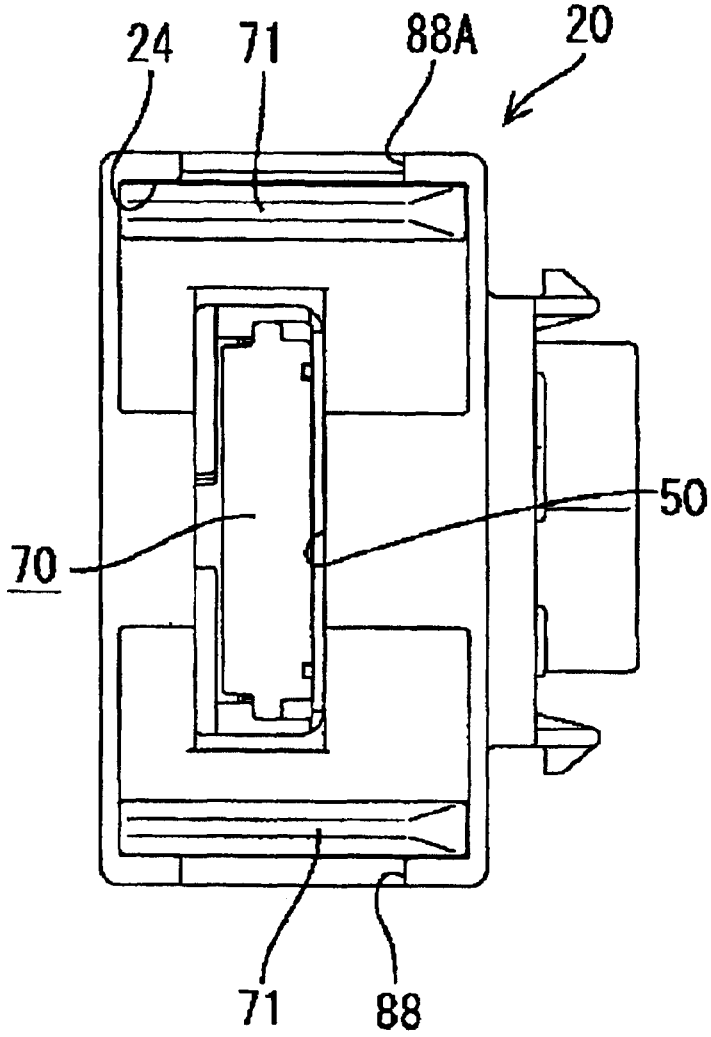
FIG. 15 is a side view of the female housing with the slider mounted at the advanced position.
Figure 17:
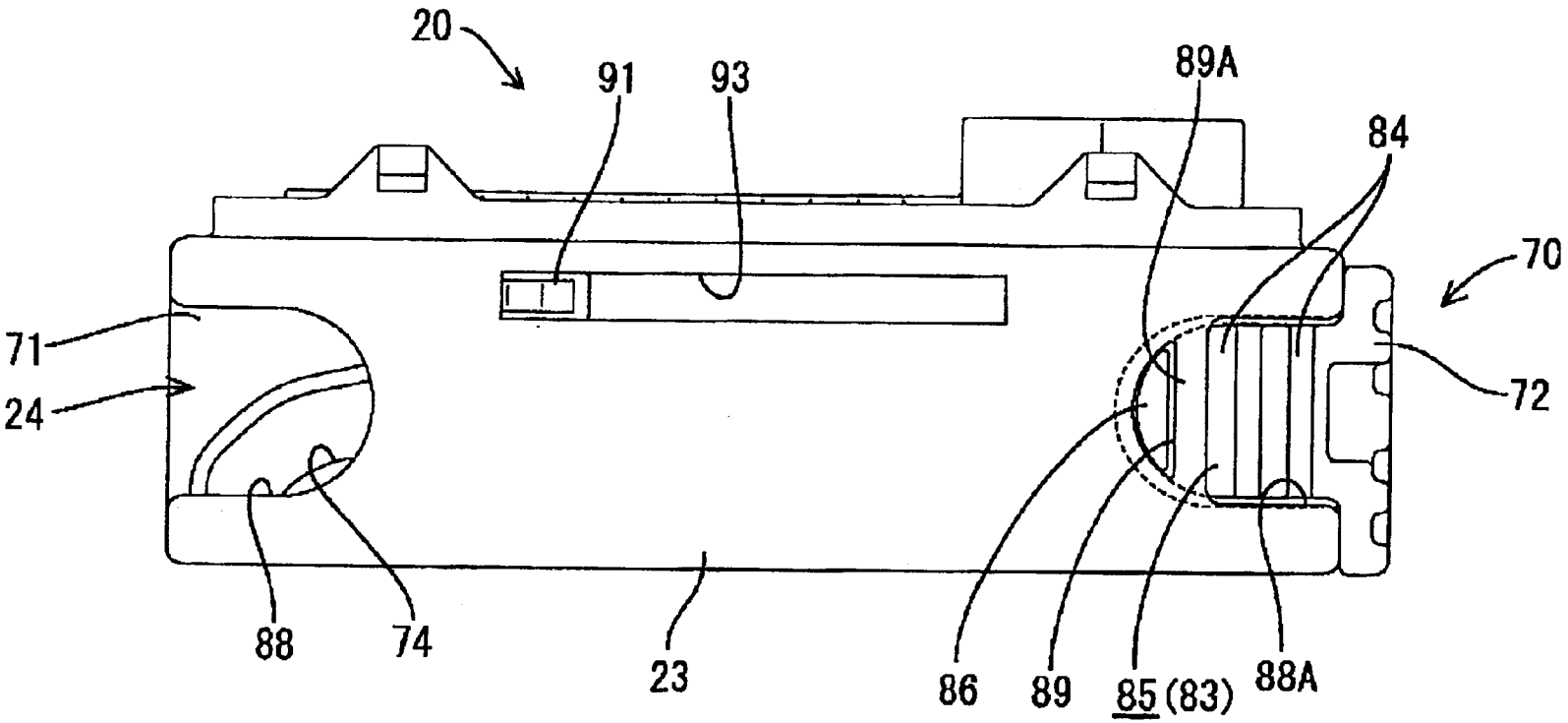
FIG. 17 is a bottom view of the female housing with the slider mounted at the advanced position.

FIG. 14 shows the upper covering portion 23 as an example and the escaping slot 88 is formed at the left end when viewed from the front. An escaping slot 88A is formed at the right end of the lower cover 23, as shown in FIG. 17, and a bridge 89A is formed at a leading end portion of this escaping slot 88A, thereby forming a lock hole 89 into which the locking claw 86 of the locking piece 85 is fittable for locking.

It should be noted that an arrangement of the escaping slots at the right end is vertically reversed from that of the escaping slots at the left end.

Each slidable plate 71 of the slider 70 has a partial locking piece 90 approximately at the lengthwise center of the cam groove 74 and near the rear of the slidable plate 71, as shown in FIGS. 11 and 12. The partial locking piece 90 cantilevers toward the base end of the corresponding slidable plate 71 and is resiliently deformable. A projection 91 is formed on the outer surface of the projecting end and has a rearward-facing slanted surface.

A locking groove 93 is formed at a longitudinal center of a rear edge of each cover 23 of the female housing 20, as shown in FIG. 1. The projection 91 of the partial locking piece 90 is freely movable in the locking groove 93, and opposite sides of the locking groove 93 with respect to longitudinal direction are closed at the front side.

The slider 70 is held at a retracted position so as not to come off, for example, by inserting the slidable plates 71 into the insertion paths 24 of the female housing 20 from the left side of FIG. 1 and engaging the projections 91 of the partial locking pieces 90 with the left edge of the locking grooves 93 in FIG. 1. At this retracted position, the entrances 75 of the cam grooves 74 substantially align with the through holes 79 of the female housing 20.

The slider 70 reaches an advanced position when the coupling plate 72 is pressed into contact with the left surface of the female housing 20. At this advanced position, the locking claw 86 of the locking piece 85 fits into the lock hole 89 of the cover 23 for locking, as shown in FIG. 17.

The slider 70 operates as described above in the case that it is mounted from the right surface of the female housing 20, and no repetitive description is given here. Thus, the slider 70 can be inserted from the left or the right depending on the installed position of the connector.

Figure 16:
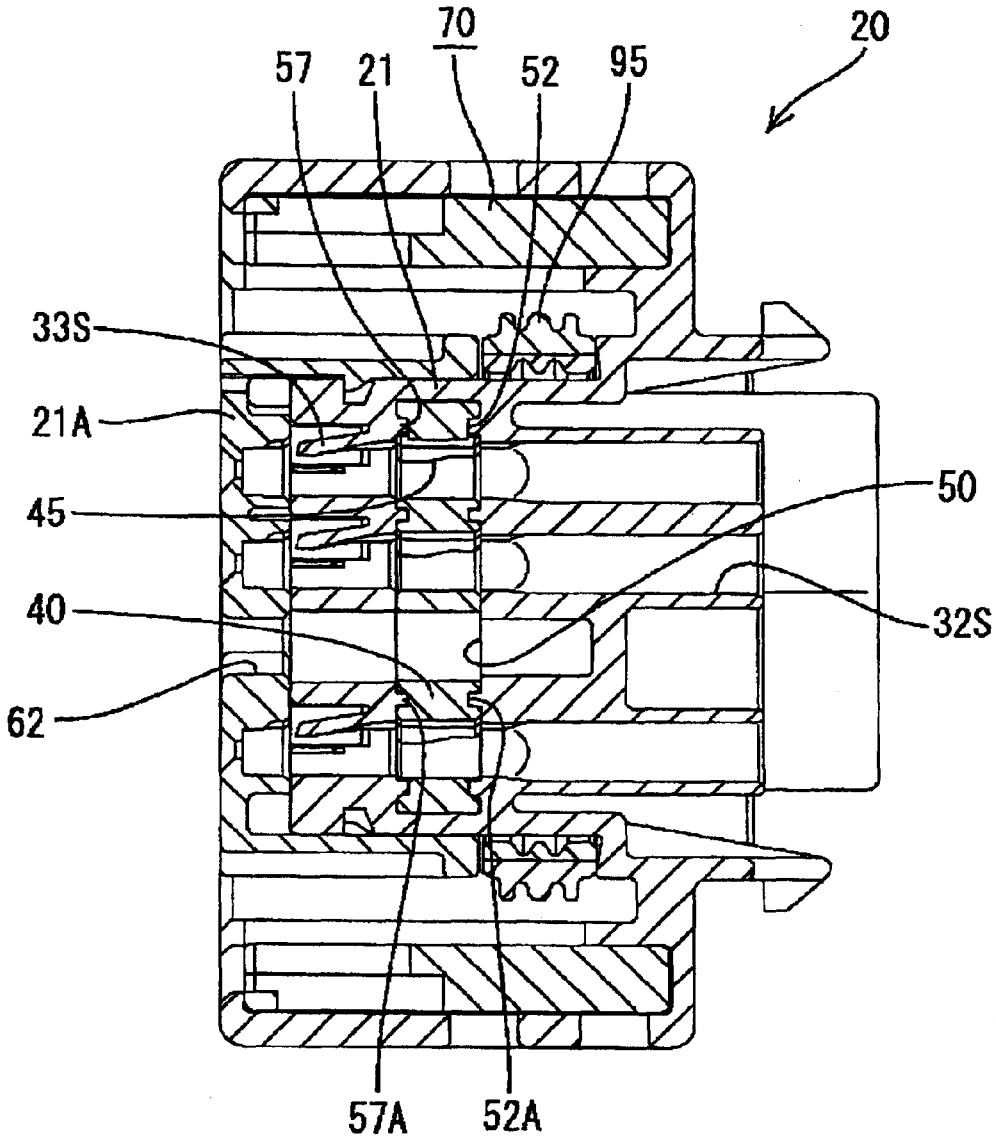
FIG. 16 is a longitudinal section of the female housing with the slider mounted at the advanced position.

The female housing 20 is assembled by mounting a packing 95 on the base end of the outer surface of the tower 21 and then mounting the front-stop 21A on the tower 21 as shown in FIG. 16. Thus, the front-stop 21A prevents the packing 95 from coming off.

The retainer 40 then is inserted into the retainer insertion opening 50 in the insertion direction ID. During insertion, the ribs 57, 57A on the wall surfaces of the retainer insertion opening 50 enter the guide grooves 52, 52A formed in the front and rear surfaces of the arms 42 of the retainer 40. The upper and lower surfaces of the retainer 40 from the locking pieces 54 to the bulging-out edges 53 also are inserted into the insertion grooves 58, and the cantilevers 46 are inserted into the insertion grooves 51 in the back surface.

The projections 59 of the insertion grooves 58 fit resiliently into the partial locking recesses 55A at the front side of the locking pieces 54 when the retainer 40 is pushed toward the end of its stroke. Thus, the retainer 40 is held temporarily at the partial locking position, as shown in FIG. 9, with the respective locking projections 45, 47 located before the corresponding cavities 32S, 32L. The guide grooves 52, 52A of the retainer 40 engage the ribs 57, 57A and the bulging-out edges 53 of the retainer 40 engage the insertion grooves 58. Thus, the arms 42 are prevented from being deformed and curved at the side of the small female terminal locking portion 41S despite the long and narrow shapes of the arms 42. As a result, a projection of deformed sections of the arms 42 into the small cavities 32S can be avoided, and the small female terminals 26S can be inserted and withdrawn smoothly. Additionally, the retainer 40 can be inserted smoothly because the guide grooves 52, 52A, the ribs 57, 57A, the bulging-out edges 53 and the insertion grooves 58 function as guides.

The female terminals 26 are mounted when the retainer 40 is at the partial locking position. More particularly, the small female terminals 26S are inserted into the corresponding small cavities 32S from behind and resiliently deform the small locks 33S. The small locks 33S are restored resiliently toward their original shape when the small terminals 26S are pushed to a specified position. Thus, the small locks 33S engage the engaging portions 29 and partly lock the small female terminals 26S. The large female terminals 26L are inserted similarly into the corresponding large cavities 32L from behind and are locked partly by the resilient engagement of the large locks 33L.

The retainer 40 is pushed from the partial locking position to the full locking position of FIG. 10 after all large and small female terminals 26S, 26L have been inserted. Thus, the projections 59 fit in the full locking recesses 55B instead of the partial locking recesses 55A. The respective locks 45 of the small female terminal locking portion 41S enter the small cavities 32S behind the jaws 30 of the small female terminals 26S in the small cavities 32S, thereby doubly locking the small female terminals 26S. On the other hand, the respective locks 47 of the large female terminal locking portion 41L enter the large cavities 32L behind the jaws of the large female terminals 26L in the large cavities 32L, thereby doubly locking the large female terminals 26L.

Simultaneously, the slider 70 is mounted on the female housing 20 and is pushed to the advanced position by inserting the slidable plates 71 into the insertion paths 24 from the left side of the female housing 20. Specifically, the slider 70 is pushed first while the partial locking pieces 90 are deformed resiliently. At an intermediate stage, the partial locking pieces 90 are restored resiliently to fit into the locking grooves 93 and are moved along the locking grooves 93. At a final stage of pushing the slider 70, the locking claw 86 moves against the bridge 89A and the locking piece 85 deforms resiliently. The coupling plate 72 then contacts the left surface of the female housing 20 and the lock claw 86 moves beyond the bridge 89A, as shown in FIG. 17. Thus, the locking piece 85 is restored resiliently and the locking claw 86 fits into the lock hole 89 to hold the slider 70 at the advanced position.

The slider 70 is mounted at the advanced position, as described above, and the female housing 20 and slider 70 are transported to a location for connection with the male housing 10. The slider 70 is returned to the retracted position prior to connection of the housings 10, 20 by holding the upper and lower grips 83 of the slider 70 between two fingers to deform the locking piece 85 and to disengage the locking claw 86 from the lock hole 89. The slider 70 then is pulled with the grips 83 still held. During this time, the partial locking pieces 90 return along the locking grooves 93 until the projections 93 abut against the ends of the locking grooves 93. Thus, the slider 70 is held at the retracted position shown in FIG. 1.

The male housing 10 then is fitted into the large receptacle 22 of the female housing 20, as shown by an arrow in FIG.

Figure 18:
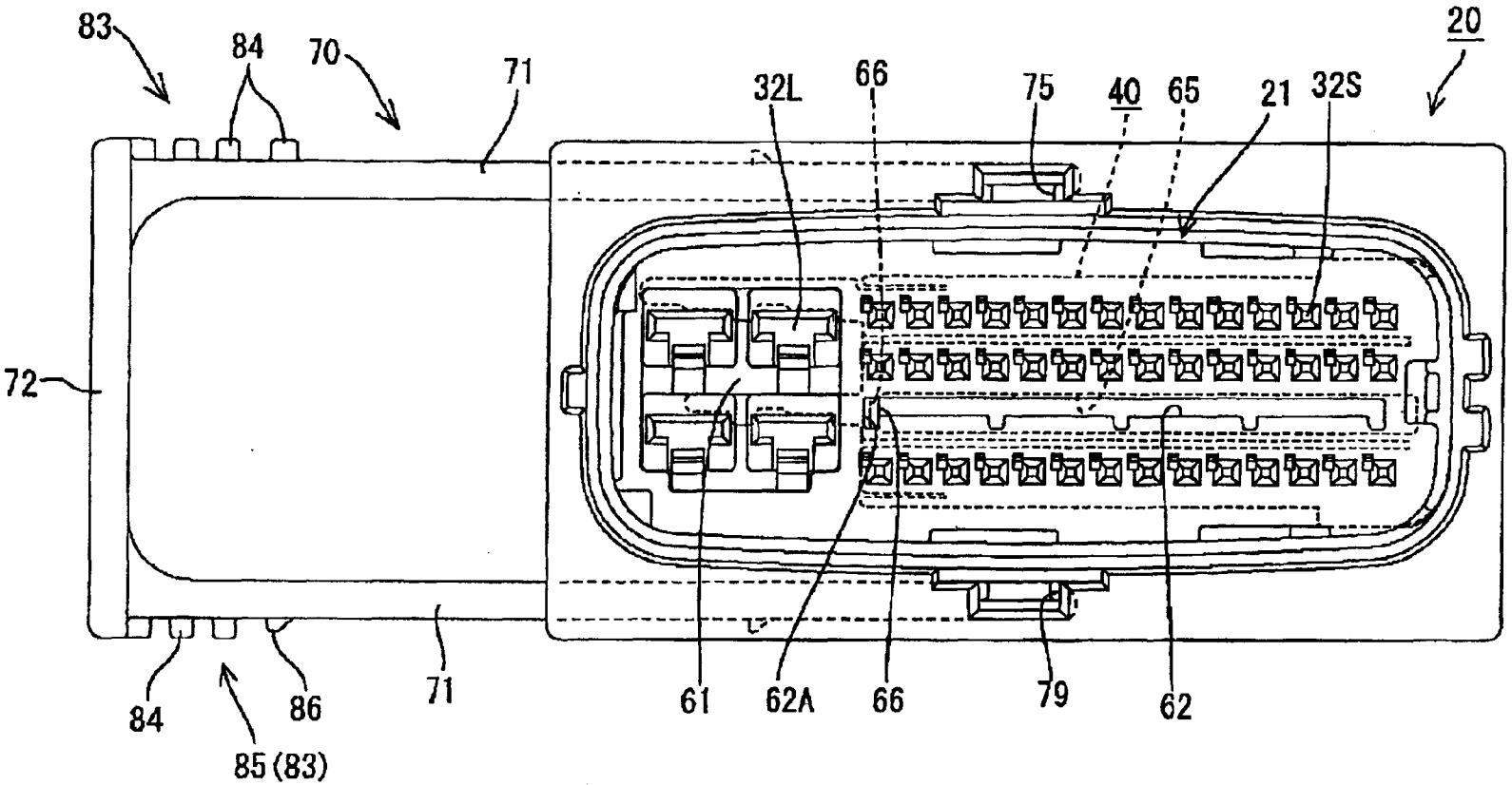
FIG. 18 is a front view showing a state where the retainer is left at the partial locking position.

1. The male housing 10 can be moved linearly with ease because the ribs 16, 17, 18 of the male housing 10 are guided along the corresponding grooves 61, 62, 63 of the female housing 20. At this stage, the retainer 40 must be at the full locking position in the female housing 20. However, an operator may inadvertently leave the retainer 40 at the partial locking position. In this situation, the detector 66 at the back of the through hole 65 of the retainer 40 is inside the back edge 62A of the lateral groove 62 as shown in FIG. 18, when the lateral rib 16 enters the lateral groove 62. Thus, the corresponding end of the lateral rib 16 contacts the detector 66 and hinders any further connection. In this way, an incompletely inserted the retainer 40 can be detected, and the retainer 40 may be pushed to the full locking position.

The retainer 40 may be inserted insufficiently to a position near the full locking position. Thus, the detecting portion 66 is slightly inside the back edge 62A of the lateral groove 62 as shown in chain line in FIG. 18. However, the rounded portion 68 at the corner of the corresponding end of the lateral rib 16 contacts the edge of the detecting portion 66 when the lateral rib 16 enters the lateral groove 62. As a result, the retainer 40 is moved to automatically to the full locking position.

The follower pins 77 of the male housing 10 enter the entrances 75 of the cam grooves 74 through the through holes 79, if the connection of the housings 10, 20 is started properly. The male housing 10 then is pushed further and the follower pins 77 push the back edges (upper edges in FIG. 19) of the draw-in portions 80, as shown in FIG. 19. Thus, the slider 70 moves a specified distance toward its advanced position along the inclination of the cam grooves 74. As a result, the follower pins 77 enter the starting ends 74A of the cam grooves 74. This also prevents disengagement of the male housing 10 by catching the follower pins 77 by the front edges of the draw-in portions 80.

Figure 20:
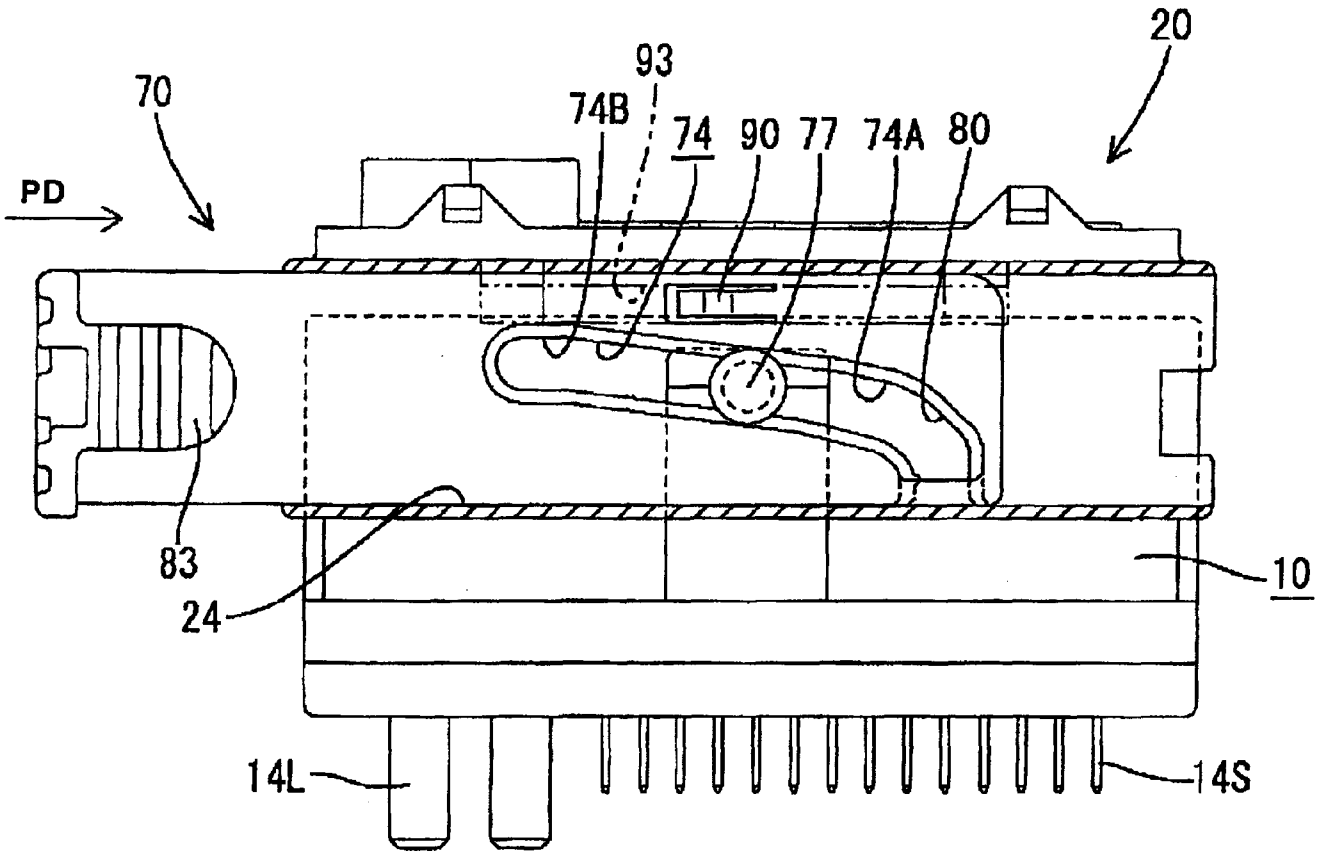
FIG. 20 is a plan view partly in section showing an intermediate stage of connection of the male and female housings.
Figure 21:
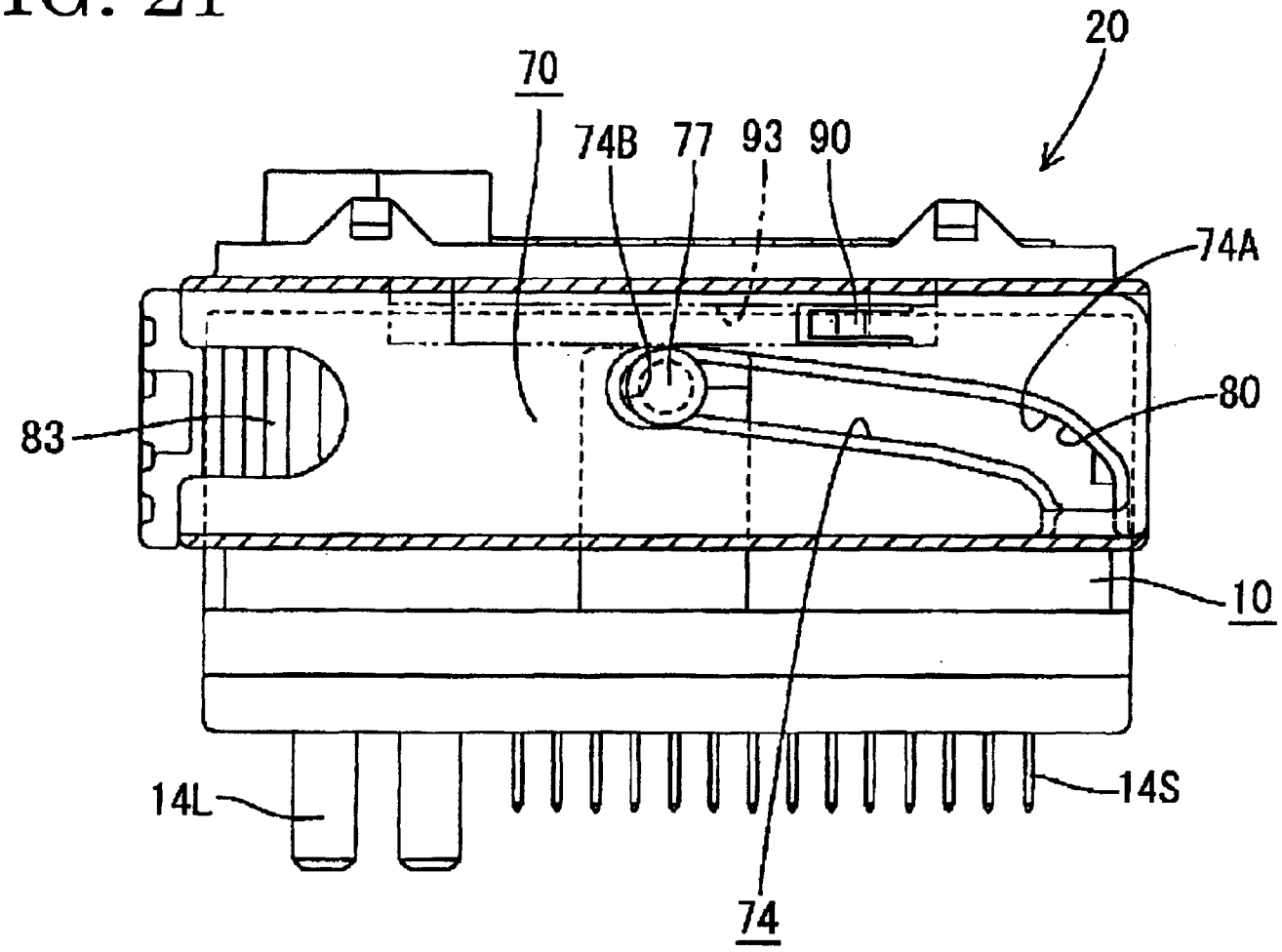
FIG. 21 is a plan view partly in section showing a final state of connection of the male and female housings.

Subsequently, the slider 70 is pushed in the pushing direction PD, parallel to the insertion direction ID, and toward the advanced position, as shown by an arrow in FIG. 19. The front edges of the cam grooves 74 then push the follower pins 77, as shown in FIG. 20, and the male housing 10 is pushed gradually into the female housing 20. The follower pins 77 move toward back ends 74B of the cam grooves 74 when the slider 70 is pushed to the advanced position, as shown in FIG. 21. As a result, the male and female housings 10, 20 are connected properly with each other. The locking claw 86 of the locking piece 85 is locked in the lock hole 89 when the slider 70 is pushed to the advanced position, as shown in FIG. 17. Thus, the housings 10, 20 also are locked simultaneously into each other and are connected properly.

The housings 10, 20 are detached from each other by gripping the gripping portions 83 of the slider 70 in the state of FIG. 21. The locking piece 85 is deformed resiliently to effect unlocking and the slider 70 is pulled. Then, the back edges of the cam grooves 74 push the follower pins 77, and the male housing 10 is pushed gradually out and away from the female housing 20. When the slider 70 is pulled back to the retracted position, the follower pins 77 are returned to the entrances 75 of the cam grooves 74. Thus, the male housing 10 is pulled successively and detached from the female housing 20 while the follower pins 77 are pulled forward through the through holes 79.

As described above, the guide grooves 52, 52A are formed in both front and rear surfaces of the arms 42 that have the locking projections 45 in the retainer 40. The ribs 57, 57A are formed on opposite wall surfaces of the retainer insertion opening 50 and extend along the inserting direction ID of the retainer 40 for engagement with the corresponding guide grooves 52, 52A. Thus, deformation of the arms 42 can be prevented despite their long narrow shapes. This eliminates undesirable events such as a projection of the deformed sections of the arms 42 toward the small cavities 32S. For example, when the retainer 40 is located at the partial locking position, the small female terminals 26S can be inserted into the corresponding small cavities 32. Further, the retainer 40 can be pushed to the full locking position without any problem after the insertion of the small female terminals 26S.

The retainer 40 can be inserted smoothly because of the guiding function of the guide grooves 52, 52A and the ribs 57, 57A.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

Converse to the foregoing embodiment, ribs may be formed on the arms of the retainer while forming guide grooves in the wall surfaces of the retainer insertion opening.

The deformation and the like of the arms of the retainer can be prevented effectively even if the guide grooves or the ribs are provided only one of the front and rear surfaces of the arms.

The present invention is applicable to a wide range of connectors in general provided with a side-type retainer.

What is claimed is:

1. A connector, comprising:

a housing with a plurality of cavities configured respectively for receiving terminal fittings along an inserting direction, the cavities being arranged in at least one stage in said housing such that the cavities in each said stage are disposed substantially in a plane across said housing;

a retainer insertion opening formed in one side surface of the housing and extending at an angle to the inserting direction, such that the retainer insertion opening communicates with each said cavity;

a retainer configured for insertion into the retainer insertion opening along a retainer inserting direction, the retainer comprising at least one arm extending along the retainer inserting direction and a plurality of locks formed on the arm for locking the corresponding terminal fittings; and at least one groove and at least one rib extending in the retainer inserting direction and being engageable with each other, the groove and the rib being provided respectively between the arm of the retainer and at least one side wall of the retainer insertion opening such that engagement of the groove and the rib prevent deflection of the arm in directions transverse to the retainer inserting direction for achieving proper positioning of the locks.

2. The connector of claim 1, wherein the cavities are disposed at a plurality of said stages in the housing, the retainer having a plurality of arms for the respective stages of the cavities.

3. The connector of claim 2, wherein the at least one groove and the at least one rib are formed between at least one side surface of each said arm and the at least one side wall of the retainer insertion opening substantially facing the arms.

4. The connector of claim 3, wherein the retainer and the housing comprise locking means for alternately holding the retainer at a partial looking position where the locks are retracted laterally from the corresponding cavities for permitting insertion and withdrawal of the terminal fittings and at a full locking position where the locks are inside the corresponding cavities for locking the terminal fittings in the respective cavities.

5. The connector of claim 1, wherein the at least one rib is formed with slanted portions for guided entry into the corresponding groove.

6. The connector of claim 1, wherein lengths of the at least one rib and the at least one groove substantially corresponds to a length of the retainer.

7. The connector of claim 1 wherein a slider is provided on the housing and has a cam mechanism for supporting connection of the housing with a mating housing.

8. The connector of claim 7, wherein a detector is provided on the retainer for detecting an insufficient insertion of the retainer by interacting with the slider.

9. The connector of claim 8, wherein the housing has at least one rounded portion for contacting the retainer, and a detecting portion for moving the retainer to the full looking position.

10. The connector of claim 2, wherein the retainer is free of supports connecting the arms at locations between the respective locks.

11. A connector, comprising:

a housing with a plurality of cavities arranged in a plurality of stages, such that the cavities in each of said stages define a substantially planar array of side-by-side cavities, a retainer insertion opening extending into a first side of the housing and towards a second side of the housing, the retainer insertion opening communicating with each of said cavities;

an elongate retainer slidably movable in the retainer insertion opening along a retainer inserting direction, the retainer having a first end in proximity to the first side of the housing and a second end in proximity to the second side of the housing a plurality of arms corresponding in number to the plurality of stages of cavities, each of said arms being supported respectively at the first and second ends of the retainer and being unconnected to one another at locations between the first and second ends of the retainer, each said arm having a plurality of locks disposed for alignment with the corresponding cavities in the respective stage; and interengaged grooves and ribs formed respectively on the arms and at least one side wall of the retainer insertion opening of the housing and extending along the retainer inserting direction for supporting the arms relative to the respective stages of the cavities as the retainer is moved slidably along the retainer inserting direction in the retainer insertion opening, such that engagement of the grooves and ribs prevent deflection of the arms in directions transverse to the retainer inserting direction for achieving proper positioning of the locks relative to the respective cavities.

12. The connector of claim 11, wherein the cavities are substantially parallel to one another, and each said cavity extends along a terminal inserting direction, the retainer being slidably movable in the retainer insertion opening along a retainer inserting direction extending at an angle to the terminal inserting direction.

* * * * *